US010643508B2

(12) United States Patent
Aimi

(10) Patent No.: US 10,643,508 B2
(45) Date of Patent: May 5, 2020

(54) EQUIPMENT, DISPLAY-OBJECT COMPONENT, AND DISPLAY-OBJECT FIXING METHOD

(71) Applicant: ALPINE ELECTRONICS, INC., Tokyo (JP)

(72) Inventor: Satoru Aimi, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 16/282,637

(22) Filed: Feb. 22, 2019

(65) Prior Publication Data

US 2019/0355285 A1 Nov. 21, 2019

(30) Foreign Application Priority Data

May 16, 2018 (JP) ..... 2018-094489

(51) Int. Cl.
*G09F 13/04* (2006.01)
*G09F 7/18* (2006.01)
*G09F 3/02* (2006.01)

(52) U.S. Cl.
CPC ..... *G09F 13/04* (2013.01); *G09F 7/18* (2013.01); *G09F 2003/0222* (2013.01); *G09F 2007/1882* (2013.01)

(58) Field of Classification Search
CPC ..... G09F 2007/1882
See application file for complete search history.

(56) References Cited

U.S. PATENT DOCUMENTS 5,262,215 A * 11/1993 Shields ..... A63F 3/0665 428/16
5,933,867 A * 8/1999 Corder ..... A41D 19/0051 2/160
2011/0013378 A1* 1/2011 Silvermint ..... G09F 13/18 362/97.1
2014/0007475 A1 1/2014 Fu et al.
2014/0377495 A1* 12/2014 Yang ..... G09F 3/02 428/42.2

FOREIGN PATENT DOCUMENTS

JP 2014-13896 A 1/2014

* cited by examiner

*Primary Examiner* — Kristina N Junge
(74) *Attorney, Agent, or Firm* — Brinks Gilson & Lione

(57) ABSTRACT

Provided is a logo-plate component including a release sheet attached to the bottom face of a logo plate having an adhesive layer on the bottom face, the release sheet being provided with a cut-away portion exposing a part of the bottom face of the adhesive layer. Equipment is shipped with the logo-plate component temporarily fixed to an equipment body by the adhesive force of the exposed portion of the adhesive layer inside the cut-away portion of the release sheet. A user for the equipment detaches the temporarily fixed logo-plate component from the equipment body, detaches the release sheet from the logo plate, and fixes the logo plate to the equipment body in a desired orientation with the adhesive layer on the back face of the logo plate.

5 Claims, 6 Drawing Sheets

FIG. 3A1
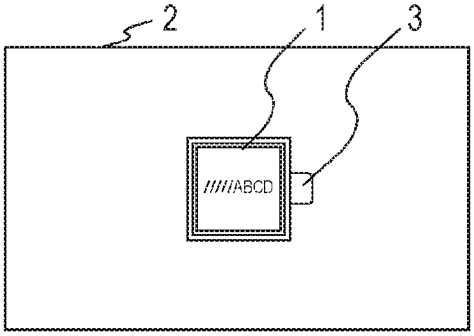
FIG. 3A2
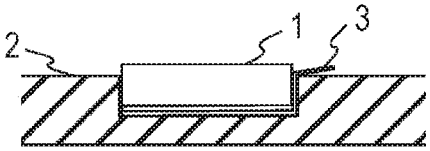
FIG. 3B1
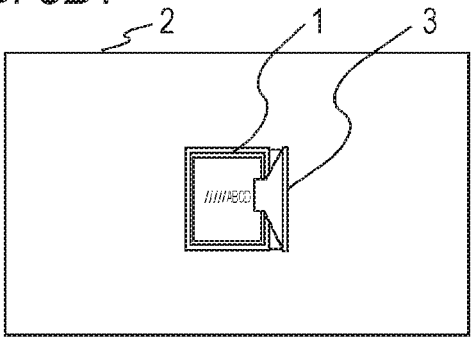
FIG. 3B2
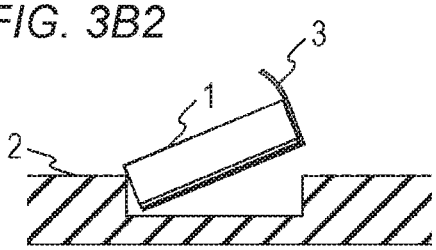
FIG. 3C
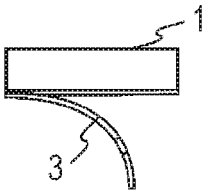
FIG. 3D
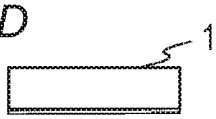
FIG. 3E
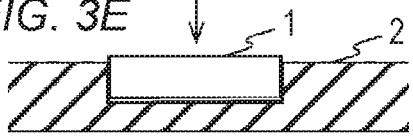
FIG. 3F1
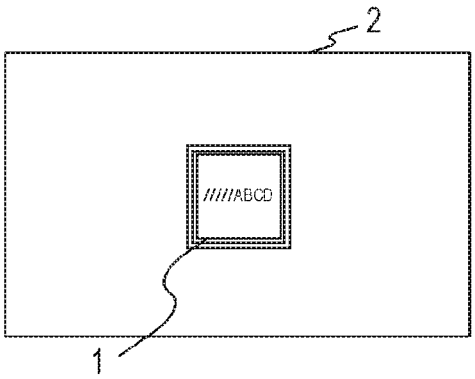
FIG. 3F2
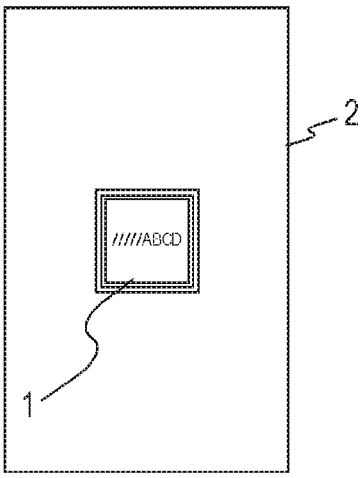

EQUIPMENT, DISPLAY-OBJECT COMPONENT, AND DISPLAY-OBJECT FIXING METHOD

RELATED APPLICATIONS

The present application claims priority to Japanese Patent Application Number 2018-094489, filed May 16, 2018, the entirety of which is hereby incorporated by reference.

BACKGROUND

1. Field

The present disclosure relates to a technique of fixing a display object to equipment.

2. Description of the Related Art

When fixing a display object, such as a logo plate, to equipment, there is a known technique of coupling a display object rotatably to equipment such that the display object can be made correct in position regardless of a mode of use of the vertical orientation/horizontal orientation of the equipment (e.g., JP 2014-13896 A).

SUMMARY

The above technique of fixing a display object rotatably to equipment requires that a display object or equipment is provided with a particular structure or mechanism enabling the display object to rotate relative to the equipment.

Meanwhile, as a method of fixing a display object to equipment, fixing a display object to equipment with adhesion is the easiest and most inexpensive method.

However, fixation of a display object to equipment usable in a vertical orientation/horizontal orientation, with adhesion, prior to shipment of the equipment, causes a possibility that the display object cannot be made correct in position depending on a mode of use of the vertical orientation/horizontal orientation of the equipment.

Thus, it is considered that a display object may be packed with equipment to which the display object is not fixed is shipped and then a user fixes the display object to the equipment with adhesion such that the display object has an orientation based on a mode of use of the vertical orientation/horizontal orientation of the equipment.

However, this manner may cause the user to forget to fix the display object to the equipment and may cause the user to use the equipment without the display object, resulting in a possibility that a problem occurs.

That is, for example, in a case where a display object includes a logo plate displaying a logo of the brand of equipment, a user is a distributor for the equipment, and the distributor exhibits the equipment to which the logo plate is not fixed, loss of the advertising opportunity of the brand or spoiling of the appearance of the equipment may reduce the appeal of the equipment.

Thus, an objective of the present disclosure includes: enabling a user to fix a display object to an equipment body with adhesion in a desired orientation, and preventing the user from forgetting to fix the display object to the equipment body.

In order to achieve the objective, according to one aspect of the present disclosure, equipment is provided having an equipment body and a display-object component. The display-object component includes: a display object having a display face and an adhesive layer formed on a face opposite to the display face; and a release sheet releasably attached to the adhesive layer, the release sheet covering the adhesive layer at least partially. The equipment body has a fixing face to which the display object is to be fixed. The display-object component is detachably attached to the fixing face of the equipment body with the release sheet interposed between the fixing face of the equipment body and the display object.

According to the equipment, favorably, the release sheet of the display-object component has a tongue-shaped portion protruding outside the face opposite to the display face.

According to the equipment, the release sheet may cover the adhesive layer partially such that part of the adhesive layer is exposed, and the display-object component may be detachably attached to the fixing face of the equipment body by adhesive force of the exposed portion of the adhesive layer, with the release sheet interposed between the fixing face of the equipment body and the display object.

According to the equipment, the release sheet may cover the adhesive layer entirely, and the display-object component may be detachably attached to the fixing face of the equipment body by adhesive force of an adhesive object disposed between the release sheet and the fixing face of the equipment body, with the release sheet interposed between the fixing face of the equipment body and the display object.

According to the equipment, the equipment body may have a recess in which a bottom face serves as the fixing face, the recess enabling insertion of the display object and the display-object component into the recess in any orientation of a plurality of orientations, and the display-object component inserted in the recess may be detachably attached to the fixing face of the equipment body, with the release sheet interposed between the fixing face of the equipment body and the display object.

According to the equipment in which the release sheet covers the adhesive layer partially such that part of the adhesive layer is exposed, the equipment body may have a recess in which a bottom face serves as the fixing face and an output face for illumination light, the recess enabling insertion of the display object and the display-object component into the recess in any orientation of a plurality of orientations. In this case, in a final fixing state where the display object inserted in the recess in any orientation of the plurality of orientations is directly attached to the fixing face by adhesive force of the adhesive layer without the release sheet interposed between the fixing face of the equipment body and the display object, the display object may transmit the illumination light output from the fixing face, partially outside the display face such that a predetermined emitting pattern is formed on the display face. In this case, favorably, the release sheet covers the adhesive layer partially such that a portion of the adhesive layer is not exposed, the portion being to overlap, when the display-object component is detachably attached to the fixing face, a portion through which the light to form the predetermined emitting pattern is likely to pass in the final fixing state, in the fixing face.

According to the equipment in which an adhesive object is disposed between the release sheet and the fixing face of the equipment body, the equipment body may have a recess in which a bottom face serves as the fixing face and an output face for illumination light, the recess enabling insertion of the display object and the display-object component into the recess in any orientation of a plurality of orientations. In this case, in a final fixing state where the display object inserted in the recess in any orientation of the plurality of orientations is directly attached to the fixing face by adhesive force of the adhesive layer without the release sheet interposed between the fixing face of the equipment body and the display object, the display object may transmit the illumination light output from the fixing face, partially outside the display face such that a predetermined emitting pattern is formed on the display face. In this case, favorably, the adhesive object is disposed so as not to overlap, when the display-object component is detachably attached to the fixing face, a portion through which the light to form the predetermined emitting pattern is likely to pass in the final fixing state, in the fixing face.

In addition, according to one aspect of the present disclosure, provided is a display-object component including: a display object having a display face and an adhesive layer formed on a face opposite to the display face; and a release sheet releasably attached to the adhesive layer, the release sheet covering the adhesive layer partially such that part of the adhesive layer is exposed.

In addition, according to one aspect of the present disclosure, provided is a display-object component including: a display object having a display face and an adhesive layer formed on a face opposite to the display face; a release sheet releasably attached to the adhesive layer, the release sheet covering the adhesive layer; and an adhesive object disposed on a face of the release sheet, the face being not in contact with the adhesive layer.

In addition, according to one aspect of the present disclosure, provided is a display-object fixing method of fixing a display object to a fixing face of an equipment body, the display object having a display face and an adhesive layer formed on a face opposite to the display face, the display-object fixing method including: detachably attaching, to the fixing face of the equipment body, a display-object component including the display object and a release sheet releasably attached to the adhesive layer, the release sheet covering the adhesive layer at least partially, with the release sheet interposed between the fixing face of the equipment body of the fixing face; detaching the display-object component from the fixing face of the equipment body; releasing the release sheet from the display object; and fixing the display object to the fixing face of the equipment body by adhesive force of the adhesive layer with press of the face opposite to the display face of the display object from which the release sheet is released, against the fixing face of the equipment body.

According to the equipment, the display-object component, and the display-object fixing method, the display-object component including the release sheet covering the adhesive face of the display object is shipped at least partially, detachably attached to the equipment body. Thus, a user for the equipment can fix the display object to the equipment body by the adhesive force of the adhesive layer in any orientation after detaching the display-object component from the equipment body and releasing the release sheet. Integrated shipment of the equipment body and the display-object component, can prevent the user from overlooking the display-object component and forgetting to fix the display object to the equipment body. In a case where the tongue-shaped portion is provided, the presence of the tongue-shaped portion in appearance enables the user to recognize that the display-object component is temporarily fixed, so that the display-object component remaining temporarily fixed can be prevented from being used.

As described above, one aspect of the present disclosure enables the user to fix the display object to the equipment body with adhesion in a desired orientation and can prevent the user from forgetting to fix the display object to the equipment body.

BRIEF DESCRIPTION OF THE DRAWINGS

FIGS. 3A1 to 3F2 are views of a fixing procedure of the logo plate according to the embodiment of the present disclosure;

FIGS. 5A to 5E2 are views of other exemplary configurations of the logo-plate component according to the embodiment of the present disclosure; FIGS. 6F1 to 6F5 are views of a fixing procedure of the logo plate according to the embodiment of the present disclosure.

DETAILED DESCRIPTION

An embodiment of the present disclosure will be described below.

FIGS. 1A to 1D illustrate the relationship between a logo plate and an equipment body according to the present embodiment.

Figure 1A:
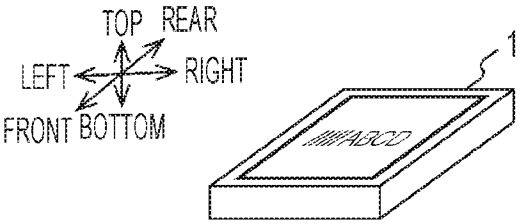
FIGS. 1A to 1D are views of equipment and a logo plate according to an embodiment of the present disclosure.

As illustrated in FIG. 1A, the logo plate 1 has a top face on which the logo of a brand is displayed, the logo determining the top, bottom, left, right, front, and rear of the logo plate 1. The logo plate 1 has a bottom face provided with an adhesive layer including an adhesive material.

Figure 1B:
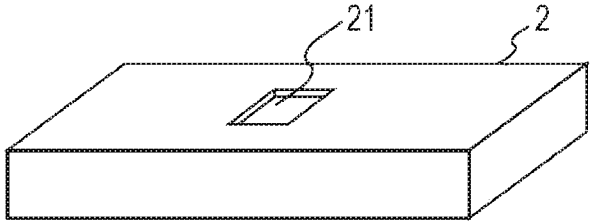

Next, as illustrated in FIG. 1B, an equipment body 2 is included in electronic equipment, such as an audio power amplifier. A recess 21 that is hollow for insertion of the logo plate 1, is provided on one face of the housing of the equipment body 2.

Here, the recess 21 has a shape into which the logo plate 1 can be inserted at least in either portrait orientation or landscape orientation. That is, in the illustrated example, both of the shape in the front, rear, left, and right directions of the logo plate 1 and the opening shape of the recess 21 are square such that the logo plate 1 can be inserted into the recess 21 of the equipment body 2 in four orientations different by 90 degrees.

Figure 1C:
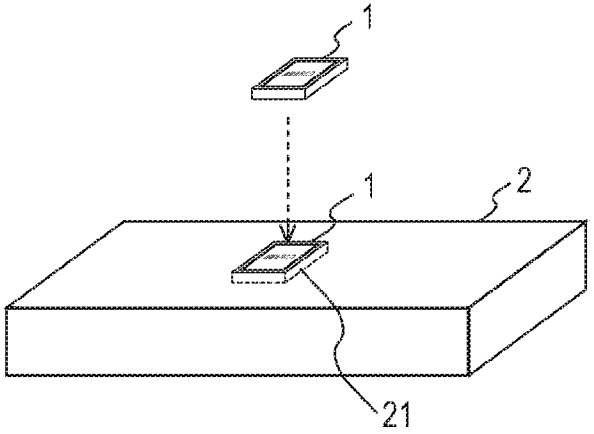
Figure 1D:
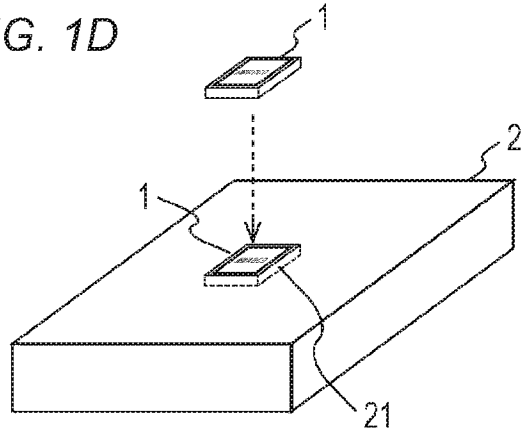

Next, the equipment body 2 is usable in both of portrait orientation and landscape orientation. As illustrated in FIGS. 1C and 1D, in accordance with the orientation of use of the equipment body 2, a user sets the orientation of the logo plate 1 such that the logo to be visually recognized is correct in position. Then, the user inserts the set logo plate 1 into the recess 21 of the equipment body 2, so that the logo plate 1 can be fixed to the equipment body 2 with the adhesive layer on the back face of the logo plate 1.

Next, FIGS. 2A to 2G illustrate a logo-plate component according to the present embodiment.

Figure 2A:
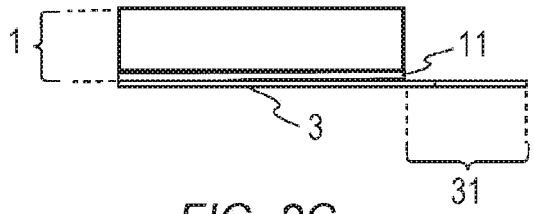
FIGS. 2A to 2G are views of a logo-plate component according to the embodiment of the present disclosure.
Figure 2B:
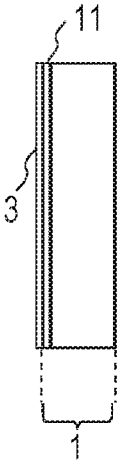
Figure 2C:
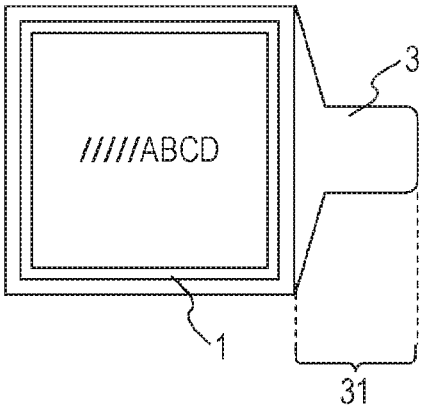
Figure 2D:
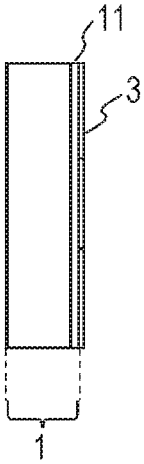
Figure 2E:
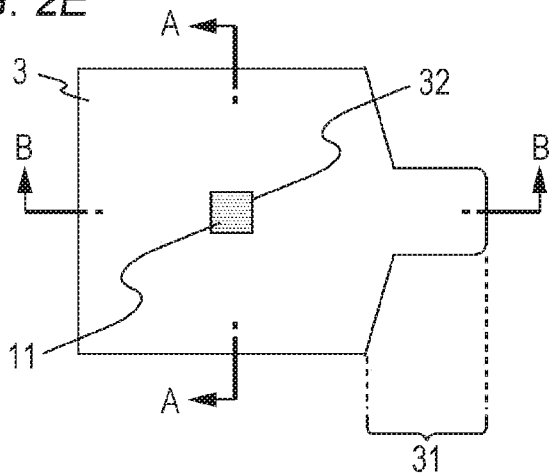

FIG. 2A illustrates the rear face of the logo-plate component, FIG. 2B illustrates the left-side face of the logo-plate component, FIG. 2C illustrates the top face of the logo-plate component, FIG. 2D illustrates the right-side face of the logo-plate component, and FIG. 2E illustrates the bottom face of the logo-plate component. Note that the front face of the logo-plate component appears similarly to the rear face.

Figure 2F:
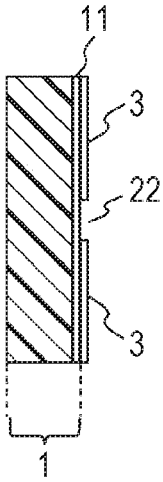
Figure 2G:
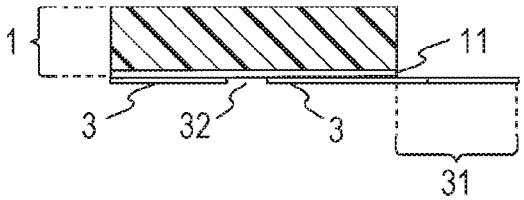

FIG. 2F illustrates a section taken along sectional line AA of FIG. 2E, and FIG. 2G illustrates a section taken along sectional line BB of FIG. 2E.

As illustrated, the logo-plate component includes a release sheet 3, which by the adhesive force of the adhesive layer 11, is attached to the bottom face of the logo plate 1, having the adhesive layer 11 on the bottom face such that the adhesive layer 11 is substantially covered. Note that the face abutting on the adhesive layer 11, of the release sheet 3, includes a release-material layer, so that the release sheet 3 can be released from the logo plate 1 by relatively weak force.

The release sheet 3 has a tongue-shaped portion 31 protruding laterally from the logo plate 1 when viewed in the up-and-down direction (right in the figure).

The release sheet 3 has a cut-away portion 32 that is the absent portion of the release sheet 3 at part of the range in which the release sheet 3 overlaps the logo plate 1 when viewed in the up-and-down direction. Part of the adhesive layer 11 on the bottom face of the logo plate 1, is exposed inside the cut-away portion 32. That is, in the illustrated example, the release sheet 3 is provided with a hole having a small region as the cut-away portion 32 at the center of the range in which the release sheet 3 overlaps the logo plate 1 when viewed in the up-and-down direction, such that a small region is exposed in the central portion of the adhesive layer 11 on the bottom face of the logo plate 1.

Next, a procedure of fixing the logo plate 1 to the equipment body 2 according to the present embodiment, will be described.

First, as illustrated in FIGS. 3A1 and 3A2, the logo-plate component keeping the release sheet 3 is inserted into the recess 21 of the equipment body 2. The logo-plate component is stuck on the equipment body 2 by the adhesive force of the exposed portion of the adhesive layer 11 on the bottom face of the logo plate 1 inside the cut-away portion 32 of the release sheet 3. Then, the equipment body 2 is shipped with the logo-plate component temporarily fixed to the equipment body 2.

As illustrated in FIGS. 3B1 and 3B2, the user who uses the shipped equipment body 2 pulls up, before use, the tongue-shaped portion 31 of the release sheet 3 of the logo-plate component temporarily fixed to the equipment body 2, from the equipment body 2, to detach the logo-plate component from the equipment body 2. Here, the cut-away portion 32 of the release sheet 3 is set in size such that the adhesive force of the exposed portion of the adhesive layer 11 inside the cut-away portion 32 prevents the logo-plate component from dropping from the equipment body 2 due to usual oscillation and enables relatively easy detachment of the logo-plate component from the equipment body 2 by pulling up of the tongue-shaped portion 31.

Then, as illustrated in FIG. 3C, the user next pulls the tongue-shaped portion 31 of the release sheet 3 in a direction away from the logo plate 1, to detach the release sheet 3 from the logo plate 1.

Then, the user inserts the logo plate 1 from which the release sheet 3 is detached as illustrated in FIG. 3D, into the recess 21 of the equipment body 2 as illustrated in FIG. 3E, to fix the logo plate 1 to the equipment body 2 with the adhesive layer 11 on the back face of the logo plate 1.

Here, as described above, as illustrated in FIGS. 3F1 and 3F2, in accordance with the orientation of use of the equipment body 2, the user sets the orientation of the logo plate 1 such that the logo to be visually recognized is correct in position. The user inserts the set logo plate 1 into the recess 21 of the equipment body 2, to fix the logo plate 1 to the equipment body 2 with the adhesive layer 11 on the back face of the logo plate 1.

The embodiment of the present disclosure has been described above.

Figure 4A:
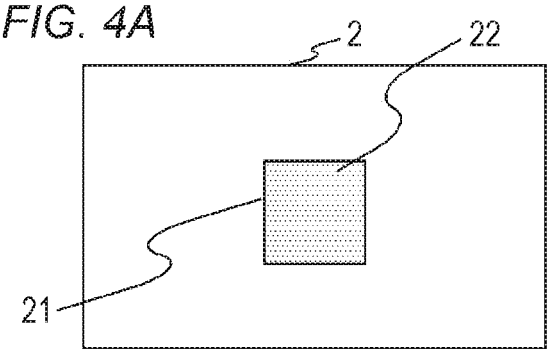
FIGS. 4A to 4E4 are views of another exemplary configuration of the logo-plate component according to the embodiment of the present disclosure.
Figure 4B:
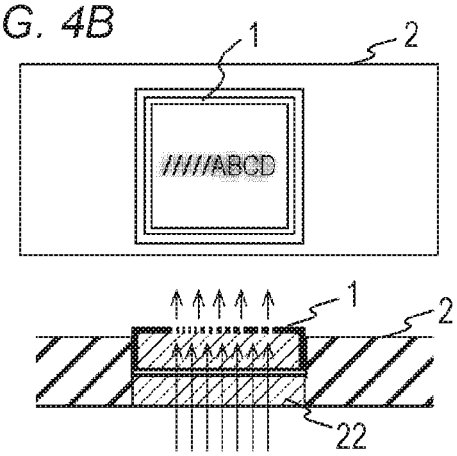
Figure 4C:
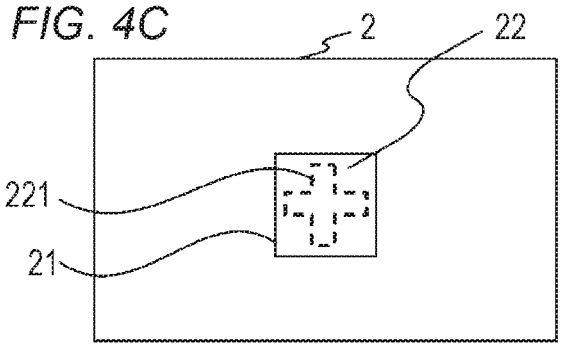

Moreover, in a case where, as illustrated in FIG. 4A, the equipment body 2 causes illumination light from an internal light source to exit through a sheet lens 22 disposed at the bottom of the recess 21 and, as illustrated in FIG. 4B, the logo plate 1 fixed to the recess 21 of the equipment body 2, causes transmission of the illumination light incident from the bottom of the recess 21, through the pattern portion of the logo, resulting in illumination of the logo, it is necessary to prevent any foreign substance from adhering to a portion 221, illustrated in FIG. 4C, through which the light to be transmitted through the logo plate 1 is likely to pass, in the sheet lens 22 at the bottom of the recess 21.

Adhesion of a foreign substance to the sheet lens 22 at the bottom of the recess 21, is caused by adhesion of the adhesive material in the exposed portion of the adhesive layer 11 on the bottom face of the logo plate 1 inside the cut-away portion 32 of the release sheet 3, to the sheet lens 22 in temporary fixation of the logo-plate component to the recess 21 of the equipment body 2.

Figure 4D:
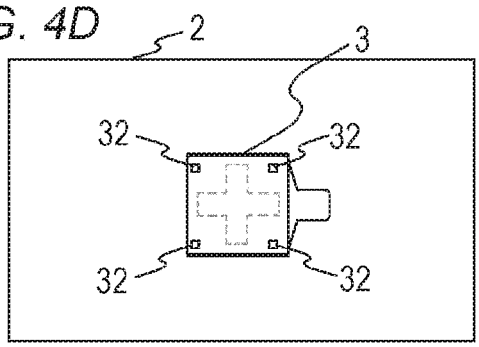
Figure 4D:
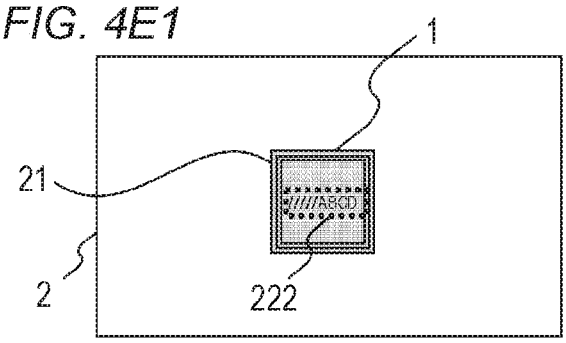
Figure 4D:
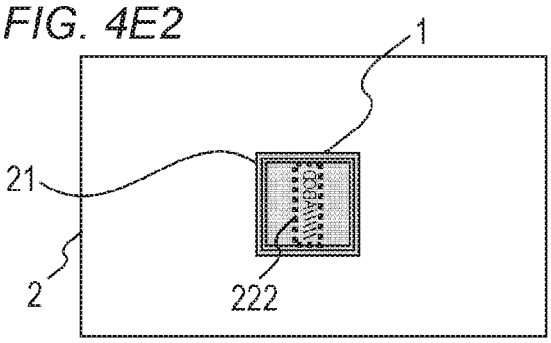
Figure 4D:
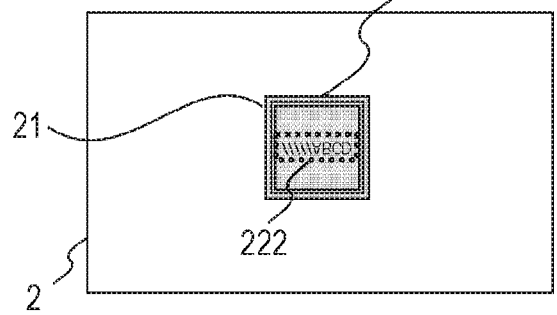
Figure 4D:
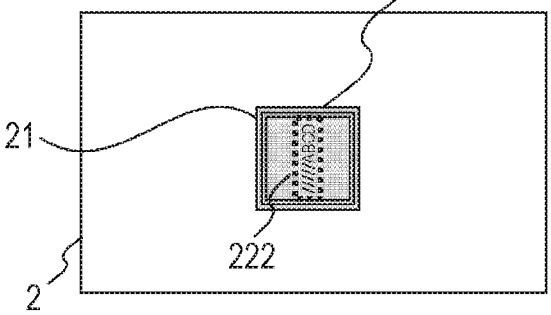

Thus, in that case, for example, as illustrated in FIG. 4D, the cut-away portion 32 of the release sheet 3 is provided so as not to overlap, in fixation of the logo plate 1, the portion 221 through which the light to be transmitted through the logo plate 1 is likely to pass, in the sheet lens 22 at the bottom of the recess 21.

Note that the portion 221 through which the light to be transmitted through the logo plate 1 is likely to pass, in the sheet lens 22 at the bottom of the recess 21, includes, as illustrated in FIGS. 4E1 to 4E4, for each orientation in which the logo plate 1 can be inserted in the recess 21, a portion 222 through which the light to be transmitted through the logo plate 1 passes when the logo plate 1 is inserted in the orientation, in the sheet lens 22.

The cut-away portion 32 of the release sheet 3 is not limited to the disposition and shape illustrated in FIGS. 2E to 2G or FIG. 4D, and thus can be variously made in disposition and shape.

Figure 5A:
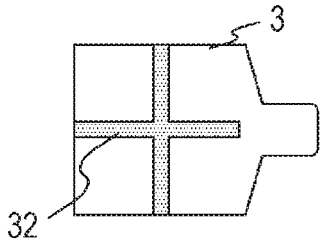
Figure 5B:
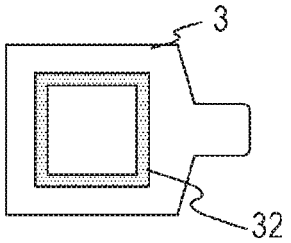
Figure 5C:
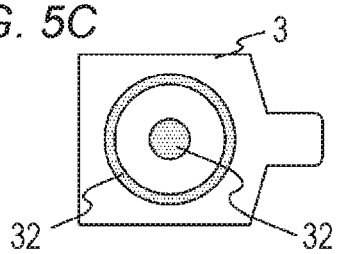
Figure 5D:
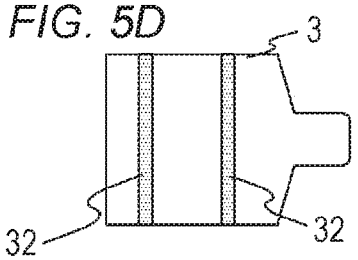
Figure 5D:
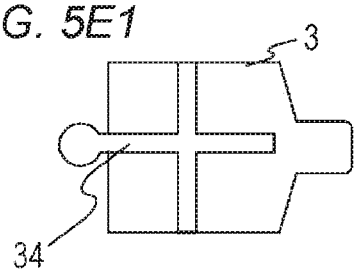
Figure 5D:
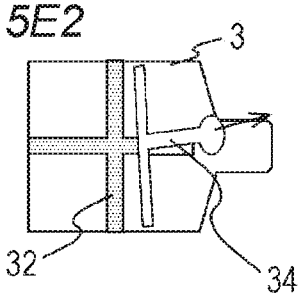

That is, for example, as illustrated in FIG. 5A, the cut-away portion 32 may be provided in a cross shape. As illustrated in FIG. 5B, the cut-away portion 32 may be provided rectangularly. As illustrated in FIG. 5C, the cut-away portion 32 may be provided concentrically. As illustrated in FIG. 5D, the cut-away portion 32 may be provided in a single-line shape or in a multiple-line shape.

The logo-plate component may be prepared, as illustrated in FIG. 5E1, such that the adhesive layer 11 is entirely covered with the release sheet 3 and a portion 34 of the release sheet 3 covering the cut-away portion 32 is separate from the other portion of the release sheet 3. In temporary fixation to the equipment body 2, as illustrated in FIG. 5E2, the cut-away portion 32 may be formed by release of only the portion covering the cut-away portion 32 in the release sheet 3.

Here, in the embodiment above, the logo-plate component is temporarily fixed to the equipment body 2 by the adhesive force of the exposed portion of the adhesive layer 11 on the bottom face of the logo plate 1 inside the cut-away portion 32 of the release sheet 3. However, instead of provision of the cut-away portion 32 at the release sheet 3, provision of an adhesive member, such as a double-sided adhesive tape or an adhesive material, on the bottom face of the release sheet 3 may allow temporary fixation of the logo-plate component to the equipment body 2.

Thus, here, FIGS. 6A to 6E illustrate the logo-plate component including a double-sided adhesive tape provided as the adhesive member on the bottom face of the release sheet 3.

Figure 6A:
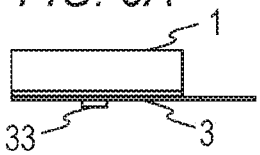
FIGS. 6A to 6E are views of another exemplary configuration of the logo-plate component according to the embodiment of the present disclosure.
Figure 6B:
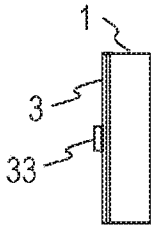
Figure 6C:
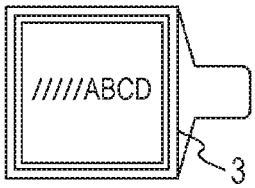
Figure 6D:
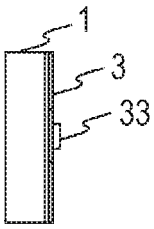
Figure 6E:
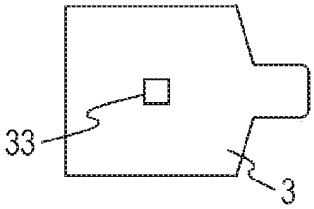
Figure 6E:
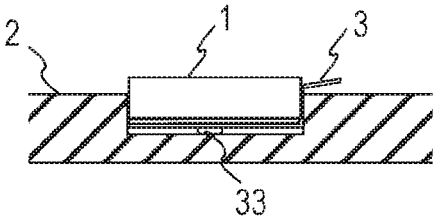
Figure 6E:
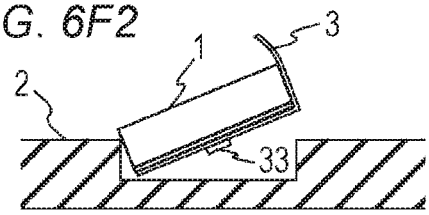
Figure 6E:
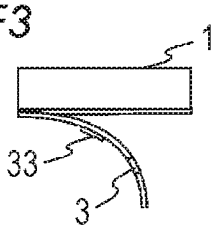
Figure 6E:
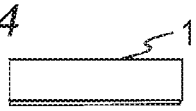
Figure 6E:
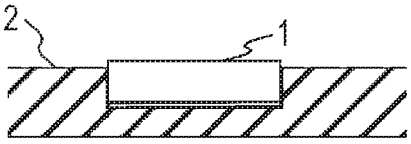

FIG. 6A illustrates the rear face of the logo-plate component, FIG. 6B illustrates the left-side face of the logo-plate component, FIG. 6C illustrates the top face of the logo-plate component, FIG. 6D illustrates the right-side face of the logo-plate component, and FIG. 6E illustrates the bottom face of the logo-plate component. Note that the front face of the logo-plate component appears similarly to the rear face.

As illustrated, instead of provision of the cut-away portion 32 at the release sheet 3, the logo-plate component includes the double-sided adhesive tape 33 attached to a position at which the double-sided adhesive tape 33 overlaps the logo plate 1 when viewed in the up-and-down direction, on the bottom face of the release sheet 3.

For this logo-plate component, as illustrated in FIG. 6F1, the logo-plate component is inserted into the recess 21 of the equipment body 2, and then the logo-plate component is stuck on the equipment body 2 by the adhesive force of the double-sided adhesive tape 33 attached to the bottom face of the release sheet 3. Thus, the equipment body 2 can be shipped with the logo-plate component temporarily fixed to the equipment body 2.

As illustrated in FIG. 6F2, the user who uses the shipped equipment body 2 pulls up, before use, the tongue-shaped portion 31 of the release sheet 3 of the logo-plate component temporarily fixed to the equipment body 2, from the equipment body 2, so that the logo-plate component can be detached from the equipment body 2. Here, the adhesive force of the double-sided adhesive tape 33 is set such that the logo-plate component is prevented from dropping from the equipment body 2 due to usual oscillation and the logo-plate component can be relatively easily detached from the equipment body 2 by pulling up of the tongue-shaped portion 31. Note that, favorably, the adhesive force on the release sheet 3 side of the double-sided adhesive tape 33 is set larger than the adhesive force on the side to adhere to the bottom side of the recess 21 such that the double-sided adhesive tape 33 is prevented from peeling from the release sheet 3 and remaining on the bottom of the recess 21 of the equipment body 2 even when the tongue-shaped portion 31 is pulled up.

As illustrated in FIG. 6F3, the user pulls the tongue-shaped portion 31 of the release sheet 3 in a direction away from the logo plate 1, to detach the release sheet 3 together with the double-sided adhesive tape 33 from the logo plate 1. The user inserts the logo plate 1 from which the release sheet 3 is detached as illustrated in FIG. 6F4, into the recess 21 of the equipment body 2 in a desired orientation as illustrated in FIG. 6F5, so that the logo plate 1 can be fixed to the equipment body 2 with the adhesive layer 11 on the back face of the logo plate 1.

Note that, in a case where the logo-plate component is temporarily fixed to the equipment body 2 with the provision of the adhesive member, such as the double-sided adhesive tape 33, in the above manner, the adhesive member is disposed so as not to overlap, in temporary fixation of the logo-plate component, the portion 221 through which the light to be transmitted through the logo plate 1 is likely to pass, in the sheet lens 22 at the bottom of the recess 21, as illustrated in FIGS. 4A to 4C, in a case where the display object causes transmission of the illumination light incident from the bottom of the recess 21 of the equipment body 2, through the pattern portion of the logo, resulting in illumination of the logo.

As described above, according to the present embodiment, the logo-plate component including the release sheet 3 covering the adhesive face of the logo plate 1 is shipped, at least partially, detachably attached to the equipment body 2. Thus, the user for the equipment can fix the logo plate 1 to the equipment body 2 by the adhesive force of the adhesive layer 11 in any orientation after detaching the logo-plate component from the equipment body 2 and releasing the release sheet 3. Integrated shipment of the equipment body 2 and the logo-plate component can prevent the user from overlooking the logo-plate component and forgetting to fix the logo plate 1 to the equipment body 2. The presence of the tongue-shaped portion 31 in appearance enables the user to recognize that the logo-plate component is temporarily fixed, so that the logo-plate component remaining temporarily fixed can be prevented from being used.

Note that, the fixation of the logo plate 1 to the equipment body 2 has been exemplarily described in the embodiment above. However, the present embodiment can be similarly applied to fixation of any display object to the equipment body 2, such as a display object for ornament of the equipment body 2, a display object displaying information regarding operations of the equipment body 2, or a display object displaying contact addresses regarding the equipment body 2.

What is claimed is:

1. Equipment comprising:

a display-object component including a display object having a display face and an adhesive layer formed on a face opposite to the display face, and a release sheet releasably attached to the adhesive layer, the release sheet covering the adhesive layer at least partially such that part of the adhesive layer is exposed;

an equipment body having a recess in which a bottom face serves as a fixing face to which the display object is to be fixed and an output face for illumination light, the recess enabling insertion of the display object and the display-object component into the recess in any orientation of a plurality of orientations;

wherein the display-object component is detachably attached to the fixing face of the equipment body by adhesive force of the exposed portion of the adhesive layer, with the release sheet interposed between the fixing face of the equipment body and the display object;

wherein in a final fixing state, where the display object inserted in the recess in any orientation of the plurality of orientations is directly attached to the fixing face by adhesive force of the adhesive layer without the release sheet interposed between the fixing face of the equipment body and the display object, the display object transmits the illumination light output from the fixing face through at least a portion of the display face to form a predetermined emitting pattern on the display face; and wherein when the display-object component is detachably attached to the fixing face, the release sheet covers the adhesive layer partially such that a portion of the adhesive layer is not exposed, the not exposed portion overlapping the portion of the display face corresponding to the predetermined emitting pattern formed on the display face, in any orientation of the plurality of orientations.

2. The equipment according to claim 1, wherein the release sheet of the display-object component has a tongue-shaped portion protruding outside the face opposite to the display face.

3. A display-object component comprising:

a display object having a display face and an adhesive layer formed on a face opposite to the display face;

a release sheet releasably attached to the adhesive layer, the release sheet covering the adhesive layer; and an adhesive object disposed on a face of the release sheet for adhering the display object component to a fixing face, the face of the release sheet being not in contact with the adhesive layer;

wherein the adhesive object is configured to remain disposed on the face of the release sheet when the release sheet is released from the adhesive layer.

4. A display-object fixing method of fixing a display object to a fixing face of an equipment body, the fixing face serving as an output face for illumination light, and the display object having a display face and an adhesive layer formed on a face opposite to the display face, the display-object fixing method comprising:

detachably attaching, to the fixing face of the equipment body, a display-object component including the display object and a release sheet releasably attached to the adhesive layer, the release sheet covering the adhesive layer partially, with the release sheet interposed between the fixing face of the equipment body and the display object;

detaching the display-object component from the fixing face of the equipment body;

releasing the release sheet from the display object; and fixing the display object to the fixing face of the equipment body by adhesive force of the adhesive layer with press of the display face of the display object from which the release sheet is released, against the fixing face of the equipment body;

wherein, when the display object is fixed to the fixing face of the equipment body by adhesive force of the adhesive layer, the display object transmits the illumination light output from the fixing face through at least a portion of the display face to form a predetermined emitting pattern on the display face; and wherein the release sheet covers the adhesive layer partially such that a portion of the adhesive layer is not exposed, the not exposed portion overlapping the portion of the display face corresponding to the predetermined emitting pattern on the display face.

5. Equipment comprising:

a display-object component including a display object having a display face and an adhesive layer formed on a face opposite to the display face, and a release sheet releasably attached to the adhesive layer, the release sheet covering the adhesive layer entirely; and an equipment body having a recess in which a bottom face serves as the fixing face and an output face for illumination light, the recess enabling insertion of the display object and the display-object component into the recess in any orientation of a plurality of orientations, wherein the display-object component is detachably attached to the fixing face of the equipment body by adhesive force of an adhesive object disposed between the release sheet and the fixing face of the equipment body, with the release sheet interposed between the fixing face of the equipment body and the display object;

wherein in a final fixing state, where the display object inserted in the recess in any orientation of the plurality of orientations is directly attached to the fixing face by adhesive force of the adhesive layer without the release sheet interposed between the fixing face of the equipment body and the display object, the display object transmits the illumination light output from the fixing face through at least a portion of a display face to form a predetermined emitting pattern on the display face; and wherein when the display-object component is detachably attached to the fixing face, the adhesive object is disposed so as not to overlap with the portion of the display face corresponding to the predetermined emitting pattern formed on the display face, in any orientation of the plurality of orientations.

* * * * *